US007296680B2

(12) United States Patent
Yokawa

(10) Patent No.: US 7,296,680 B2
(45) Date of Patent: Nov. 20, 2007

(54) PACKING STRUCTURE AND PACKING MEMBER OF CORRUGATED CARDBOARD

(75) Inventor: Akira Yokawa, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 416 days.

(21) Appl. No.: 10/824,453

(22) Filed: Apr. 14, 2004

(65) Prior Publication Data

US 2004/0206657 A1 Oct. 21, 2004

(30) Foreign Application Priority Data

Apr. 15, 2003 (JP) ..... 2003-002071 U

(51) Int. Cl.
*B65D 81/02* (2006.01)

(52) U.S. Cl. ..... 206/521; 206/587; 206/591; 206/594

(58) Field of Classification Search ..... 206/521, 206/523, 583, 586, 591–594, 320
See application file for complete search history.

(56) References Cited

U.S. PATENT DOCUMENTS 2,410,591 A * 11/1946 Turner ..... 206/586
3,838,632 A * 10/1974 Miyake ..... 493/276
5,385,238 A * 1/1995 Lancaster et al. ..... 206/594
5,398,808 A * 3/1995 Chen et al. ..... 206/320
5,823,352 A * 10/1998 Mena et al. ..... 206/721
6,675,973 B1 * 1/2004 McDonald et al. ..... 206/583

FOREIGN PATENT DOCUMENTS

| | | |
|---|---|---|
| JP | 6-14072 | 2/1994 |
| JP | 6-20279 | 3/1994 |
| JP | 6-44773 | 6/1994 |

* cited by examiner

*Primary Examiner*—Jila M Mohandesi
(74) *Attorney, Agent, or Firm*—Osha Liang LLP

(57) ABSTRACT

A corrugated-cardboard packing member 20 includes a pair of openings 25 provided in a bottom housing portion 21, a pair of spacer portions 22 formed so that cores of a corrugated-cardboard sheet extend in a direction substantially orthogonal to their longitudinal direction, an attachment supporting portion 26 having a longitudinal portion which extends in a direction substantially in parallel to the direction of extending the cores of the corrugated-cardboard sheet, a pair of folding portions 23 which are arranged between the opposite sides of a pair of styrofoam members 110 are folded downward in order to form the pair of openings 25, and a tip projecting portion 24 arranged to be in contact with a projection 112 of each styrofoam member 110.

5 Claims, 7 Drawing Sheets

PRIOR ART

PRIOR ART

PRIOR ART

PRIOR ART

PRIOR ART

PACKING STRUCTURE AND PACKING MEMBER OF CORRUGATED CARDBOARD

BACKGROUND OF THE INVENTION

1. Field of the Invention

The present invention relates to a packing structure and a packing member made of a corrugated cardboard (hereinafter referred to as a corrugated-cardboard packing member).

2. Description of the Related Art

Conventionally, in a packing structure in which various devices such as electric products and their attachments are packed, a packing member holding a product and its attachment(s) is arranged within a corrugated cardboard box so that they are immovable. A previously known packing member is a packing member made by molding plastic foam such as styrofoam plastic, or a packing member of corrugated cardboard (for example, See JP-UM-A-6-14072, JP-UM-A-6-020279, and JP-UM-A-6-044773).

The documents JP-UM-A-6-14072, JP-UM-A-6-020279, and JP-UM-A-6-044773 disclose a corrugated cardboard packing member which uses, as a shock absorber, a box-like portion formed by bending one or more corrugated cardboard sheets.

FIG. 6 is a schematic view of an exemplary conventional packing structure. Referring to FIG. 6, an explanation will be given of a conventional packing structure 100. The conventional packing structure 100, as seen from FIG. 6, includes a corrugated cardboard box 101, and a pair of styrofoam members 110 and a corrugated-cardboard packing member 120 which serve as packing members arranged within the corrugated cardboard box 101. The packing member 120 is arranged between the upper surface of the pair of styrofoam members 110 and the upper inner surface of the corrugated cardboard box 101 and holds an attachment 160.

FIG. 7 is a front view of the styrofoam member shown in FIG. 6. FIG. 8 is a left side view of FIG. 7. FIG. 9 is a top view of FIG. 8. Referring to FIGS. 6 to 9, the conventional styrofoam member 110 includes a concave portion 111 for holding the side of a product 150, projections 112 and 113 formed on the upper surface, projections 114 formed on the rear surface, and curved sides 115. The projections 112 and 113 formed on the upper surface serve to support the lower surface of the corrugated-cardboard packing member 120. The projections 114 formed on the rear surface of the styrofoam member 110 are located to be in contact with the inner side face of the corrugated cardboard box 101.

FIG. 10 is a perspective view of the conventional corrugated-cardboard packing member shown in FIG. 6. FIG. 11 is a perspective view of the conventional corrugated-cardboard packing member shown in FIG. 10. FIG. 12 is a perspective view for explaining the extending direction of cores of a corrugated cardboard sheet in the conventional corrugated-cardboard packing member shown in FIG. 11. Referring to FIGS. 6, 10 and 11, the conventional corrugated-cardboard packing member 120 includes a bottom housing portion 121, a pair of spacer portions 122, a pair of folding portions 123 and tip projecting portions 124.

The pair of spacer portions 122 are formed by bending both ends of the bottom housing portion 121 in a square shape and arranged to remove the gap between the upper surface of the styrofoam members 110 and the upper inner surface of the corrugated cardboard box 110. The pair of folding portions 123 are formed by bending both ends of the bottom housing portion 121 in a direction orthogonal to the direction of extension of the spacer portions 122, toward the side opposite to the side where the spacer portions are located. Each of the folding portions 123 has an arch shape. The inner side faces 123*a* of the folding portion 123 are located to be in contact with the curved sides of the styrofoam members 110, respectively. The tip projecting portions 124 are formed to project outwardly from the spacer portions 122 in such a manner that the tips of both ends of the sides of forming the spacer portions 121 are inserted into cutting portions 121*a* formed in the bottom housing portion 121, respectively. Additionally, the cores 120*a* of the corrugated cardboard sheet which constitutes the conventional corrugated-cardboard packing member 120 extend in a direction of arrow A illustrated in FIGS. 11 and 12.

FIG. 13 is a view showing the arrangement relationship between the conventional corrugated-cardboard packing member and the pair of styrofoam members illustrated in FIG. 6. Referring to FIGS. 6 and 13, in the conventional packing structure 100, when shock is applied to the corrugated cardboard box 101, the pair of styrofoam members 110 and corrugated-cardboard packing member 120 were caused to have a shock absorbing function. Specifically, the styrofoam member 110, which is elastically deformed to a certain degree when it receives the shock, has the shock absorbing function. The corrugated-cardboard packing member 120 arranged on the conventional styrofoam members 110 has the function of absorbing the shock through elastic deformation of the square spacer portions 122.

However, the conventional packing structure 100 has the following inconvenience. Namely, in the conventional packing structure 100, since the cores 120*a* of the corrugated cardboard sheet constituting the corrugated-cardboard member 120 (FIG. 12) are formed to extend in the direction of arrow A, when force is applied from above to the spacer portions 122 of the corrugated cardboard member 120, the sides 122*a* in a vertical direction of the square spacer portions 122 are likely to be not deformed elastically but bent. When the sides 122*a* in the vertical direction of the spacer portions 122 are bent, a problem occurs that the shock absorbing function of the spacer portions 122 is deteriorated. Further, the When the sides 122*a* in the vertical direction of the spacer portions 122 are bent, the height of the spacer portions 122 is reduced so that a space or gap is generated between the upper inner face of the corrugated cardboard box 101 and upper face of the spacer portions 122. Therefore, since the pair of styrofoam members 110 are likely to move vertically, a problem occurs that the product 150 falls out from the pair of styrofoam members 110 owing to the vertical movement of the pair of styrofoam members 110.

The conventional packing structure 100 shown in FIG. 6 has also the following inconvenience. Namely, when the shock in a horizontal direction is applied to the corrugated cardboard box 101, the end of one of the styrofoam member 110 is likely to move toward the opposite styrofoam member 110 (direction of arrow C in FIGS. 6 and 9). Thus, also when the end of one of the styrofoam members 110 moves in the direction of arrow C, a problem occurs that the product 150 falls.

Further, the conventional packing structure has also an inconvenience that the bottom housing portion 121 of the conventional corrugated-cardboard packing member 120, which is formed of a single corrugated-cardboard sheet, is lack of flexibility. The conventional packing structure also presents a problem that it is difficult to provide the conventional corrugated-cardboard packing member 120 with a sufficient shock absorbing function owing to the reduction of the shock absorbing function of the corrugated-cardboard packing member 120 due to the bending of the spacer portions 122 and lack of the flexibility of the bottom housing portion 121.

The conventional packing structure 100 shown in FIG. 6 has also the following inconvenience. When strong shock is applied to the corrugated cardboard box 101 owing to its dropping, great force is applied to the portion where the inner side faces 123*a* of the folding portion 123 of the corrugated-cardboard packing member 120 and the sides 115 of the styrofoam member 100 are in contact with each other so that excessive pushing force in a direction of arrow B in FIGS. 7 to 9 is applied to the sides of the styrofoam member 110. Owing to the excessive pushing force in this direction of arrow B, the sides of the styrofoam member 110 may be damaged as indicated in two-dot chain line in FIGS. 8 and 9. Also when the sides 115 of the styrofoam member 110 are damaged, the styrofoam member 110 is likely to move in a direction of arrow D in FIG. 9 so that the product 150 (FIG. 6) supported by the styrofoam members 110 falls from the styrofoam members 110.

Further, in the conventional box-like corrugated-cardboard packing member disclosed in the documents JP-UM-A-6-14072, JP-UM-A-6-020279, and JP-UM-A-6-044773, the direction of extending the cores of the corrugated cardboard sheet is not taken into consideration. Therefore, in the case where the direction of extending the cores of the corrugated cardboard sheet is longitudinal of the box portion, when force is applied vertically (short-length direction) to the box portion, the box portion may not deformed elastically but bent. In this case, like the conventional corrugated-cardboard packing member 120 shown in FIG. 10, a problem occurs that the shock absorbing function of the box portion is deteriorated. Further, like the conventional corrugated-cardboard packing member 120 shown in FIG. 10, the corrugated-cardboard packing member disclosed in the documents JP-UM-A-6-14072, JP-UM-A-6-020279, and JP-UM-A-6-044773 have an inconvenience that the bottom housing portion, which is formed of a single corrugated-cardboard sheet, is lack of flexibility. Thus, in the corrugated-cardboard packing member disclosed in the above described documents, it is difficult to provide the bottom housing portion with a sufficient shock absorbing function.

SUMMARY OF THE INVENTION

It is therefore an object of the invention to provide a corrugated cardboard packing member which is given excellent shock resistance by improving a shock absorbing function and a packing structure including the same.

In order to solve the problems, according to a first aspect of the invention, there is provided a packing structure including: a corrugated-cardboard box for housing a product; a pair of styrofoam members each of which is arranged within the corrugated cardboard box and includes a concave portion for supporting the side of the product; and a corrugated-cardboard packing member arranged to be adjacent to the pair of styrofoam members within the corrugated-cardboard box and includes a bottom housing portion for housing an attachment and a pair of spacer portions which are formed by bending both ends of the bottom housing portion in a square shape and arranged in a gap between the upper surface of the styrofoam members and the inner surface of the corrugated cardboard box, wherein the pair of styrofoam members each includes a projection on the upper surface, wherein the corrugated-cardboard packing member is formed so that cores of a corrugated cardboard sheet extend in a direction orthogonal to the direction of extending the pair of spacer portions, wherein the corrugated-cardboard packing member includes: a pair of openings formed by cutting off two predetermined areas of the bottom housing portion in a three edges of a square, respectively and folding back the remaining area downward; an attachment supporting portion located between the pair of openings and having a longitudinal area extending in a direction substantially in parallel to the direction of extending the cores of the corrugated cardboard; a pair of folding portions arranged between the opposite sides of the pair of styrofoam members and folded back downward in order to form said pair of openings; and a tip projecting portion formed in such a manner that the tip of the side of each said spacer portions on the side of bottom housing portion project downward from the spacer portions and arranged to be in contact with said projection of each said styrofoam members, respectively in such a manner that the styrofoam member is sandwiched by the tip projecting portion and each of the folding portions.

According to a second aspect of the invention, there is provided a corrugated-cardboard packing member arranged to be adjacent to a pair of holding members for holding a first article to be arranged within a corrugated cardboard box, the corrugated-cardboard packing member including: a bottom housing portion for housing a second article; a pair of spacer portions that are provided to project upward from the ends of said bottom housing portion and arranged in a gap between the upper surface of the pair of holding members and the inner surface of the corrugated cardboard box, an opening formed by cutting off a predetermined area of the bottom housing portion and folding back the remaining area downward; a second article supporting portion adjacent to said opening; and a folding portion which is arranged between the opposite sides of the pair of holding members and folded back downward in order to form said opening.

BRIEF DESCRIPTION OF THE DRAWINGS

The above objects and advantages of the present invention will become more apparent by describing a preferred embodiment thereof in detail with reference to the accompanying drawings, wherein.

DETAILED DESCRIPTION OF THE PREFERRED EMBODIMENTS

Referring now to the accompanying drawings, a description will be given in detail of a packing structure according to one or more embodiments of the invention.

Figure 1:
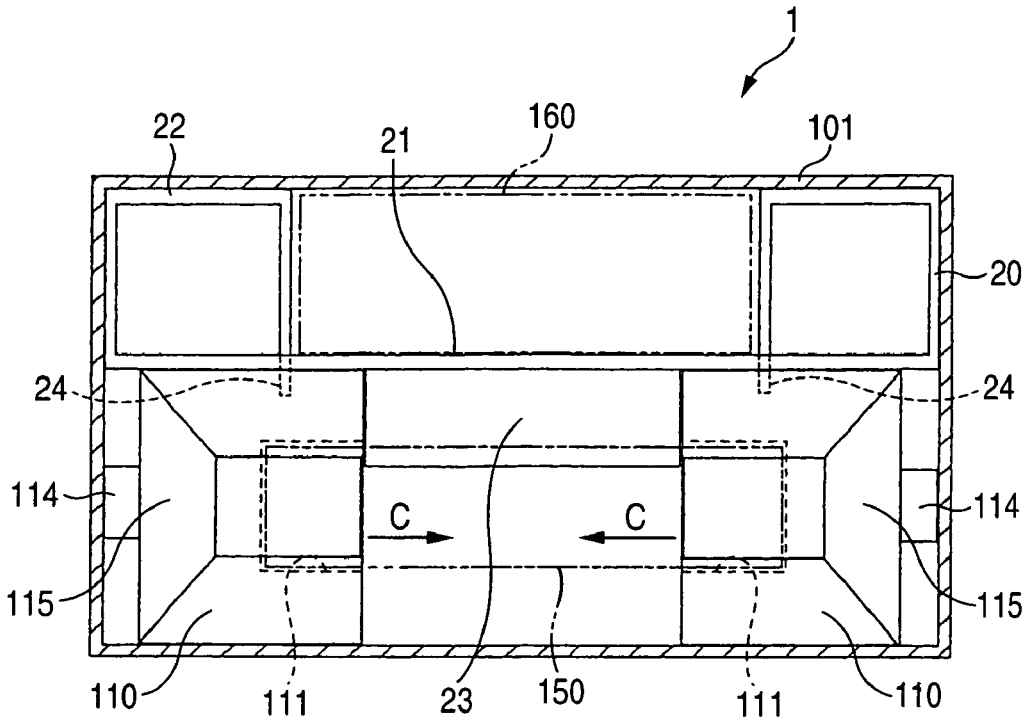
FIG. 1 is a schematic view of a packing structure according to an embodiment of the present invention.
Figure 2:
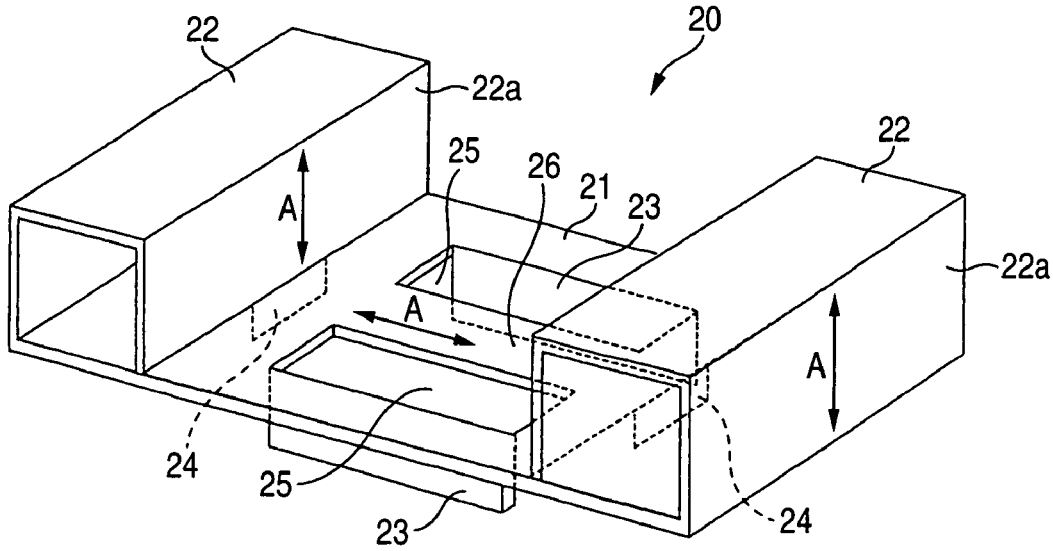
FIG. 2 is a perspective view of a corrugated-cardboard packing member which is used in the packing structure shown in FIG. 1.
Figure 3:
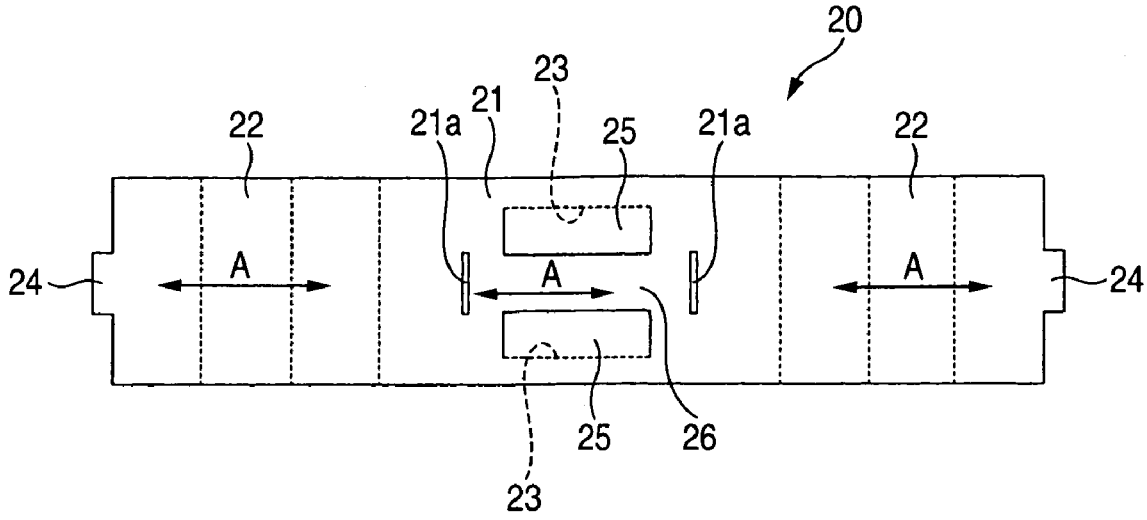
FIG. 3 is a plan developed view of the corrugated-cardboard packing member of a according to the embodiment shown in FIG. 1.
Figure 4:
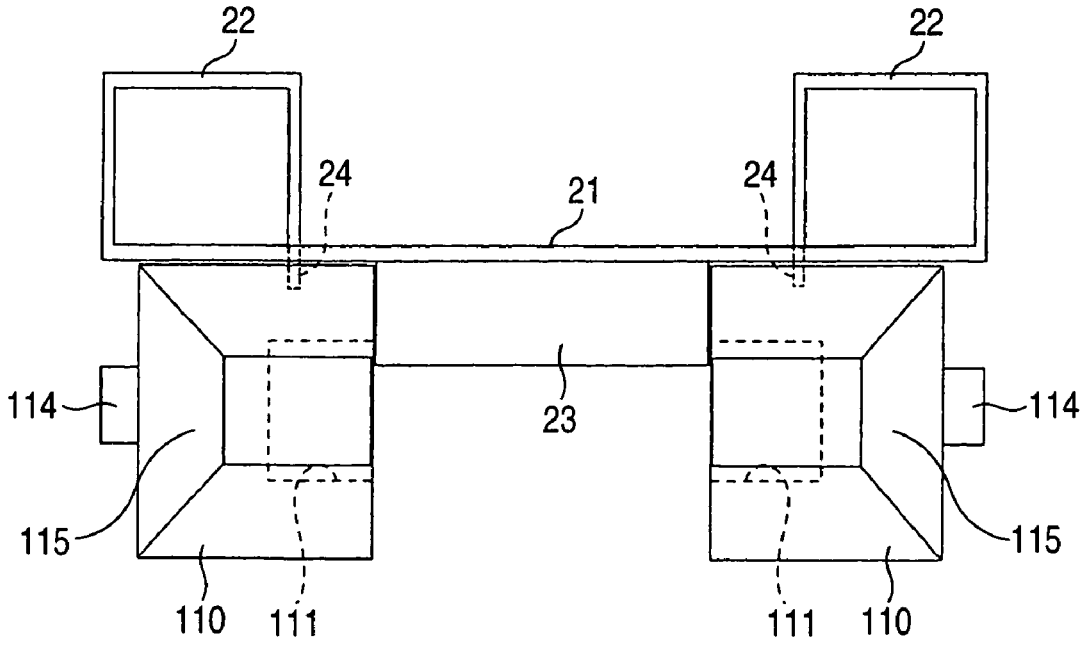
FIG. 4 is a view showing an arrangement relationship between the corrugated-cardboard packing member and a pair of styrofoam members.
Figure 5:
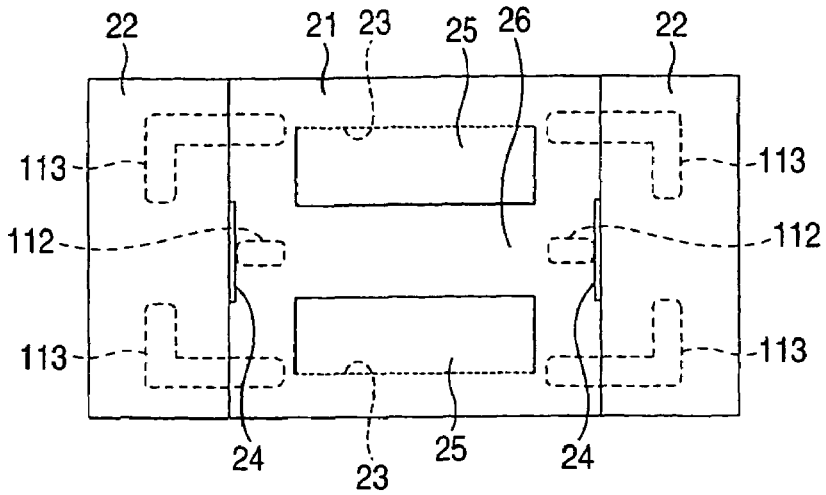
FIG. 5 is a plan view for explaining the positional relationship between the corrugated-cardboard packing member and the upper protruding portions of the pair of styrofoam members, shown in FIG. 1.
Figure 6:
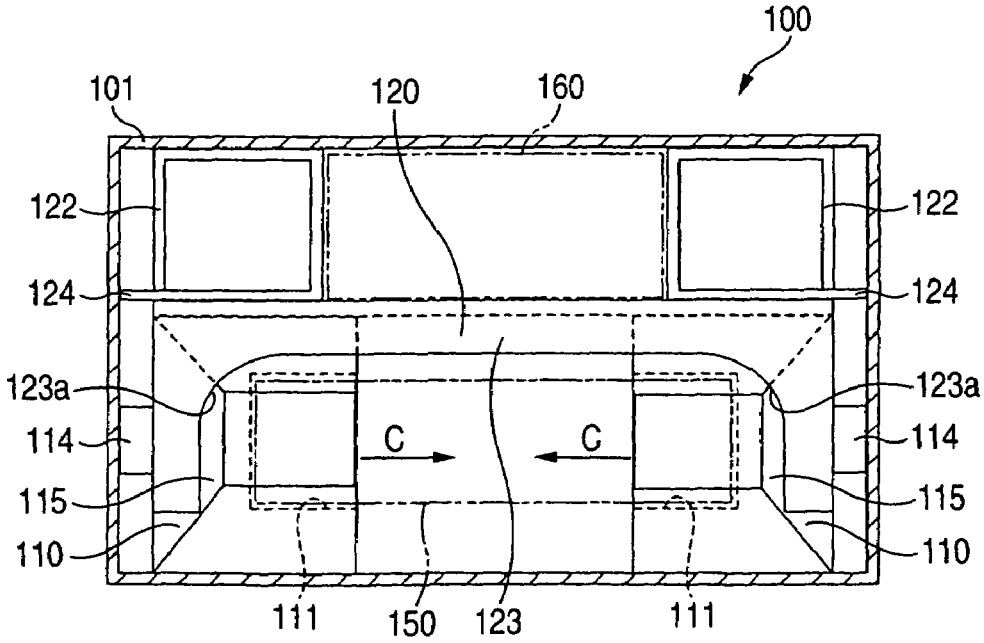
FIG. 6 is a schematic view of an exemplary conventional packing member.
Figure 7:
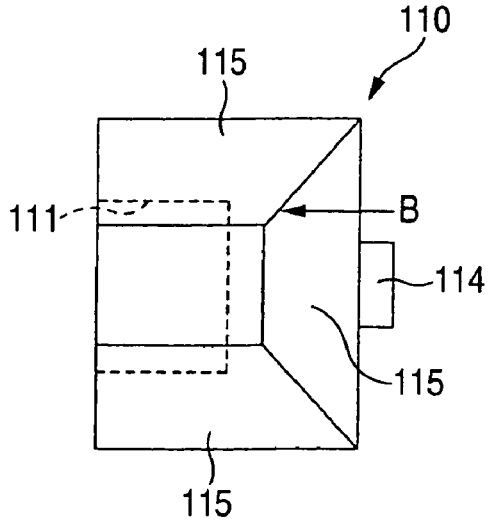
FIG. 7 is a front view of a conventional styrofoam member shown in FIG. 6.
Figure 8:
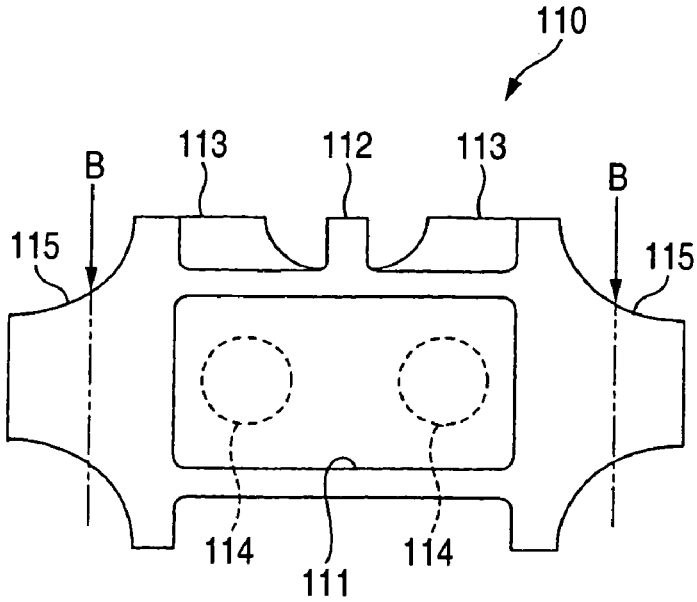
PRIOR ART FIG. 8
FIG. 8 is a left side view of the conventional styrofoam member shown in FIG. 7.
Figure 9:
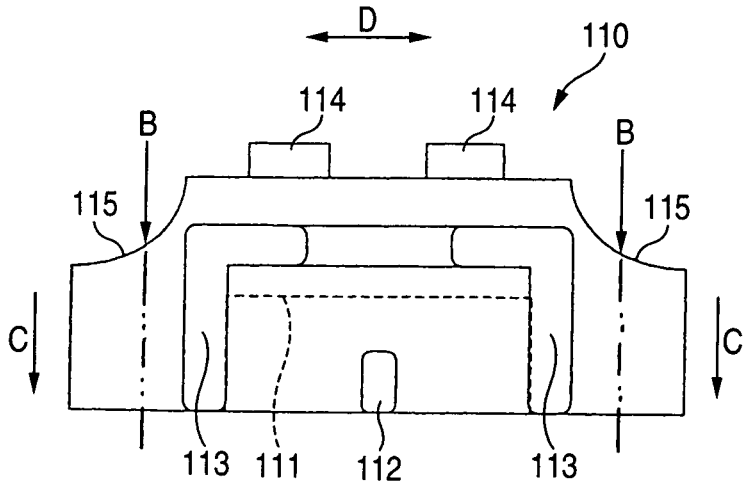
FIG. 9 is a top view of the conventional styrofoam member shown in FIG. 8.

FIG. 1 is a schematic view of a packing structure according to an embodiment of the present invention. FIG. 2 is a perspective view of a corrugated-cardboard packing member which is used in the packing structure shown in FIG. 1. FIG. 3 is a plan developed view of the corrugated-cardboard packing member of a according to the embodiment shown in FIG. 1. FIG. 4 is a view showing an arrangement relationship between the corrugated-cardboard packing member and a pair of styrofoam members. FIG. 5 is a plan view for explaining the positional relationship between the corrugated-cardboard packing member and the upper protruding portions of the pair of styrofoam members, shown in FIG. 1.

Referring now to FIG. 1, a packing structure 1 includes a corrugated cardboard box 101, a pair of styrofoam members 110, and a corrugated-cardboard packing member 120, which serve as packing members arranged within the corrugated cardboard box 101. Incidentally, the corrugated cardboard box 101 and the pair of styrofoam members 110 have the same configurations as those of the conventional corrugated cardboard box 101 and pair of styrofoam members 110 shown in FIGS. 6 to 9.

The corrugated-cardboard packing member 20 includes a bottom housing portion 21, a pair of spacer portions 22, a pair of folding portions 23, tip projecting portions 24, a pair of openings 25 and an attachment supporting portion 26. The bottom housing portion 21 is provided to house the attachment. The pair of spacer portions 22 are formed by bending both ends of the bottom housing portion 121 in a square shape. The pair of openings are formed by cutting off two predetermined areas of the bottom housing portion 21 in a three edges of a square, respectively and folding back the remaining area downward. The attachment supporting portion 26 are formed to be located between the pair of openings 25. The folding portions 23 are formed by folding back the above remaining area in order to form the openings 25 downward. The folding portions 23, as seen from FIGS. 1 and 4, are arranged between the opposite sides of the pair of styrofoam members 110. The tip projecting portions 24 are formed to project downward from the spacer portions 22 in such a manner that the tips of both ends of the spacer portions 22 on the side of bottom housing portion 21 are inserted into cutting portions 21*a* formed in the bottom housing portion 21, respectively. The tip projecting portions 24 are arranged to be in contact with the projecting portions 112 of the styrofoam members 110, respectively in such a manner that the styrofoam members 110 are sandwiched by the tip projecting portions 24 and the folding portions 23 as seen from FIG. 5.

Figure 10:
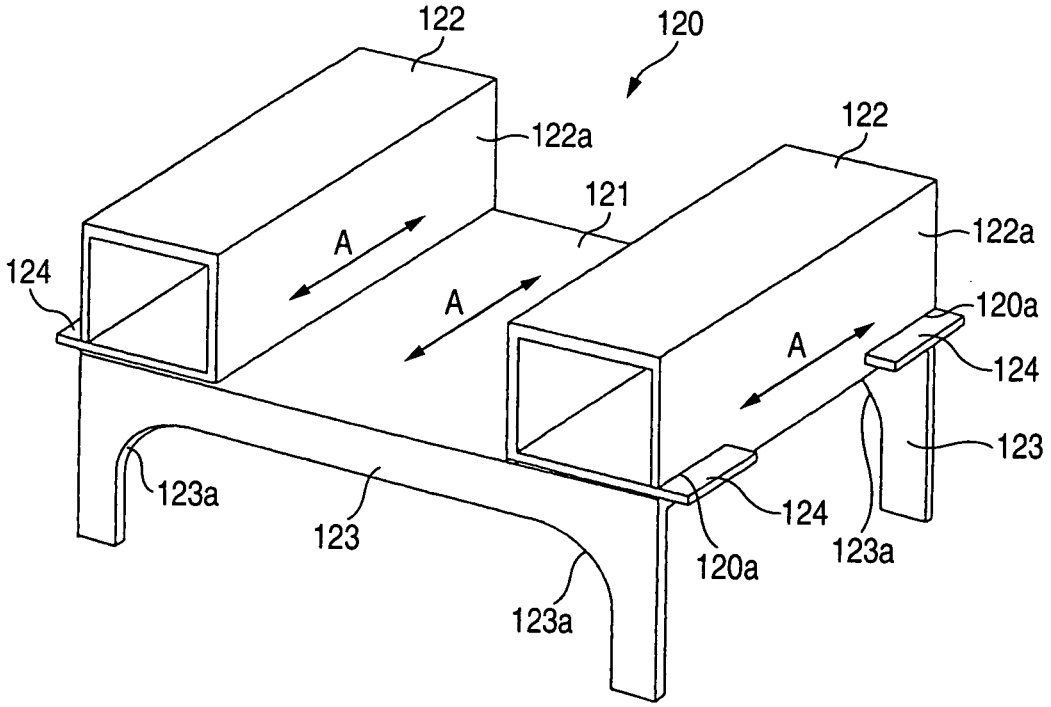
PRIOR ART FIG. 10
FIG. 10 is a perspective view of the conventional corrugated-cardboard packing member shown in FIG. 6.
Figure 11:
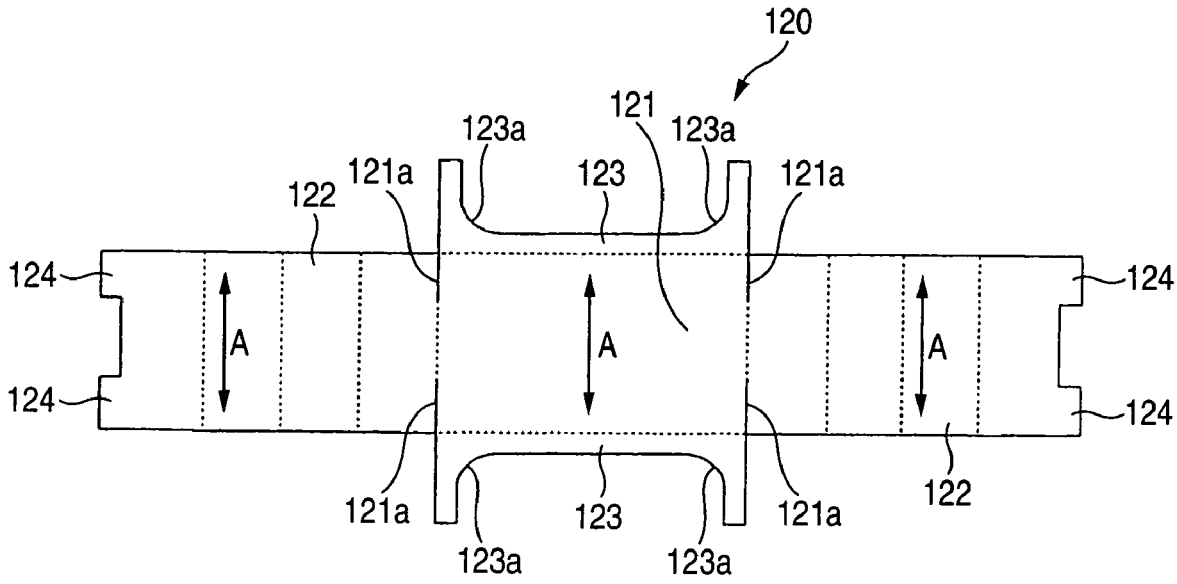
FIG. 11 is a perspective view of the conventional corrugated-cardboard packing member shown in FIG. 10.
Figure 12:
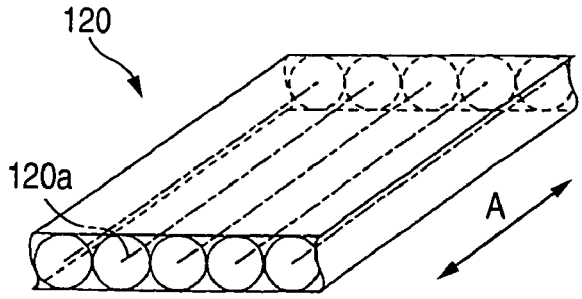
PRIOR ART FIG. 12
FIG. 12 is a perspective view for explaining the extending direction of cores of a corrugated cardboard sheet in the conventional corrugated-cardboard packing member shown in FIG. 11.
Figure 13:
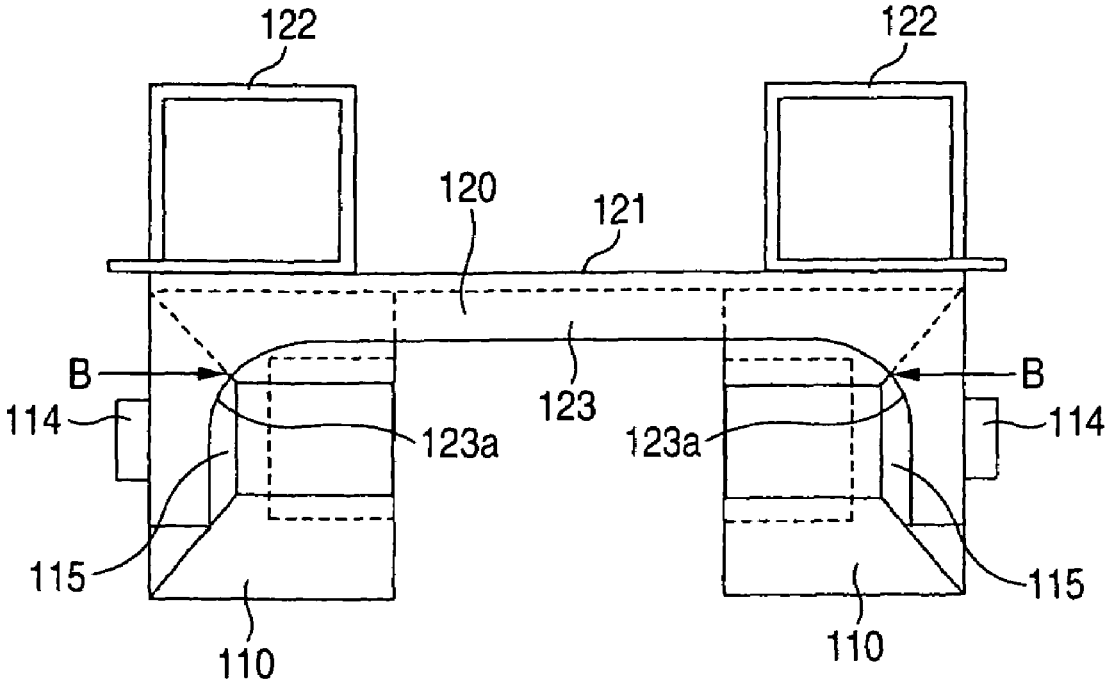
FIG. 13 is a view showing the arrangement relationship between the conventional-cardboard packing member and the pair of conventional styrofoam members shown in FIG. 6.

In this embodiment, the direction of extending the cores of the corrugated cardboard sheet constituting the corrugated-cardboard packing member 20, as indicated by arrow A in FIG. 3, is a direction in parallel to the longitudinal direction of the corrugated cardboard sheet of the corrugated-cardboard packing member 20. Namely, unlike the conventional corrugated-cardboard packing member 120 (see FIG. 10), the cores of the corrugated cardboard sheet constituting the corrugated-cardboard packing member 20 according to this embodiment are formed to extend in a direction (short-length direction) substantially orthogonal to the direction of extending the pair of spacer portions 22 (longitudinal direction). Therefore, the cores of the corrugated cardboard sheet constituting the corrugated-cardboard packing member 20 extend in a vertical direction (direction of arrow A in FIG. 2) in the vertical sides 22*a* of the pair of spacer portions 22.

In the corrugated-cardboard packing member 20 according to this embodiment, as described above, the pair of openings 25 are formed in the bottom housing portion 21 of the corrugated-cardboard packing member 20 so that the planar area of the bottom housing portion 21 is reduced, thereby improving the flexibility of the bottom housing portion 21. Thus, the bottom housing portion 21 can have a shock absorbing function. Further, in this embodiment, unlike the conventional corrugated-cardboard packing member, the cores of the corrugated cardboard sheet constituting the corrugated-cardboard packing member 20 are formed to extend in a vertical direction (direction of arrow A in FIG. 2) in the vertical sides 22*a* of the pair of spacer portions 22. Therefore, when shock is vertically applied to the spacer portions 22 owing to dropping of the corrugated cardboard box 101, the vertical sides 22*a* of the spacer portions 22 of the corrugated-cardboard packing member 20 are difficult to bend in the vertical direction as compared with those of the conventional spacer portions. Thus, when shock is applied to the spacer portions 22, these sides are not bent but can be elastically deformed. This improves the shock absorbing function of the corrugated-cardboard packing member 20. Further, the pair of spacer portions 22, which are arranged in a gap between the upper surface of the styrofoam members 110 and the inner face of the corrugated cardboard box, can be prevented from bending vertically. This prevents a space from being generated between the upper surface of the styrofoam members 110 and the inner face of the corrugated cardboard box. As a result, the styrofoam members 110 can be prevented from moving vertically, thus preventing the product 150 from falling.

In this embodiment, the folding portions 23 formed to project downward from the bottom housing portion 21 are arranged between the opposite sides of the pair of styrofoam members 110. Therefore, the end of one of the styrofoam member 110 is prevented from moving toward the opposite styrofoam member 110. Thus, it is possible to prevent the product 150 from falling from the pair of styrofoam members 110 owing to the movement of the end of one of the styrofoam members 110 toward the opposite styrofoam member 110.

In the packing structure according to this embodiment shown in FIG. 1, when shock in a horizontal direction (direction of arrow C in FIG. 1) is applied to the pair of styrofoam members 110, the pushing force due to both folding portions and sides of the product 150 will be applied to the opposite sides of the pair of styrofoam members 110. This prevents the linear pair of folding portions 23 from excessively pushing the opposite sides of the pair of styrofoam members 110. Thus, the pair of styrofoam members 110 can be prevented from being damaged owing to that the linear pair of folding portions 23 have excessively pushed the opposite sides of the pair of styrofoam members 110. Accordingly, the product 150 can be prevented from falling from the pair of styrofoam members 110 owing to that the styrofoam members 110 have been damaged.

In this embodiment, as described above, the cores of the corrugated cardboard sheet constituting the corrugated-cardboard packing member 20 are extended in a direction substantially in parallel to the longitudinal direction of the attachment supporting portion 26. Owing to this, the longitudinal area of the attachment supporting portion 26, which extends substantially in parallel to the direction of extending the cores of the corrugated cardboard sheet, are difficult to bend. Thus, in the case where an attachment 160 is placed on the attachment supporting portion 26 which a slender shape, the attachment supporting portion 26 can be prevented from bending downward.

In this embodiment, as described above, the tip projecting portions 24 are arranged to be in contact with the projecting portions 112 of the styrofoam members 110, respectively in such a manner that the styrofoam members 110 are sandwiched by the tip projecting portions 24 and the folding portions 23. Therefore, in the case where the corrugated cardboard 101 has fallen, the styrofoam members 110 can be surely prevented from moving. Accordingly, as compared with the conventional embodiment, the product 150 can be surely prevented from moving owing to movement of the styrofoam members 110.

Additionally, it should be noted that the embodiment described hitherto is exemplary but not be limited in all the points. The scope of the present invention is defined by the claims but not by the description of the embodiment. The present invention includes all the modifications in a meaning and scope equivalent to those defined by claims.

For example, in the embodiment described above, the explanation was given of the case where the product is held by the styrofoam members and the attachment is housed by the corrugated-cardboard packing member. However, the present invention should not be limited to such a case. The same effect can be obtained also in the case where other articles are housed by the styrofoam members and the corrugated-cardboard packing member.

Further, in the embodiment described above, the packing member (holding member) to be combined with the corrugated-cardboard packing member was the styrofoam member. The present invention should not be limited to such a case. The holding member made of the material other than styrofoam may be combined with the corrugated-cardboard packing member.

Further, in the embodiment described above, two openings are provided in the bottom housing portion of the corrugated-cardboard packing member. The present invention should not be limited to such a case. One or three or more openings may be provided.

According to a first aspect of the present invention, there is provided a packing structure including: a corrugated-cardboard box for housing a product; a pair of styrofoam members each of which is arranged within the corrugated cardboard box and includes a concave portion for supporting the side of the product; and a corrugated-cardboard packing member arranged to be adjacent to the pair of styrofoam members within the corrugated-cardboard box and includes a bottom housing portion for housing an attachment and a pair of spacer portions which are formed by bending both ends of the bottom housing portion in a square shape and arranged in a gap between the upper surface of the styrofoam members and the inner surface of the corrugated cardboard box, wherein the pair of styrofoam members each includes a projection on the upper surface, wherein the corrugated-cardboard packing member is formed so that cores of a corrugated cardboard sheet extend in a direction orthogonal to the direction of extending the pair of spacer portions, wherein the corrugated-cardboard packing member includes: a pair of openings formed by cutting off two predetermined areas of the bottom housing portion in a three edges of a square, respectively and folding back the remaining area downward; an attachment supporting portion located between the pair of openings and having a longitudinal area extending in a direction substantially in parallel to the direction of extending the cores of the corrugated cardboard; a pair of folding portions arranged between the opposite sides of the pair of styrofoam members and folded back downward in order to form said pair of openings; and a tip projecting portion formed in such a manner that the tip of the side of each said spacer portions on the side of bottom housing portion project downward from the spacer portions and arranged to be in contact with said projection of each said styrofoam members, respectively in such a manner that the styrofoam member is sandwiched by the tip projecting portion and each of the folding portions.

According to the first aspect of the present invention, as described above, since the pair of openings are formed by cutting off two predetermined areas of the bottom housing portion of the corrugated-cardboard packing member, which is arranged to be adjacent to the pair of styrofoam members within the corrugated cardboard box, in a three edges of a square, respectively and folding back the remaining area downward, the planar area of the bottom housing portion of the corrugated-cardboard packing member is reduced as compared with the case where no opening is provided. Correspondingly, the flexibility of the bottom housing portion can be improved. Thus, the bottom housing portion can have a shock absorbing function, thereby providing the packing structure with excellent shock resistance.

In the packing structure according to the first aspect of the present invention, the pair of folding portions folded back downward in order to form the pair of openings are arranged between the opposite sides of the pair of styrofoam members. Therefore, the end of one of the styrofoam members for housing the product is prevented from moving toward the opposite styrofoam member. Thus, when the corrugated cardboard box drops, it is possible to prevent the product from falling from the pair of styrofoam members owing to the movement of the end of one of the styrofoam members toward the opposite styrofoam member. Further, since the pair of folding portions are arranged between the opposite sides of the pair of styrofoam members where the product is housed, when the end of one of the pair of styrofoam members is about to move toward the opposite side, the pushing force due to both of the pair of folding portions and the product will be applied to the opposite sides of the pair of styrofoam members. This prevents the linear pair of folding portions from excessively pushing the opposite sides of the pair of styrofoam members. Thus, the pair of styrofoam members can be prevented from being damaged owing to that the linear pair of folding portions have excessively pushed the opposite sides of the pair of styrofoam members. Accordingly, the product can be prevented from falling from the pair of styrofoam members owing to that the styrofoam members have been damaged.

In the packing structure according to the first aspect of the present invention, the corrugated-cardboard packing member is formed so that the cores of the corrugated cardboard sheet extend in a direction (short-length direction) substantially orthogonal to the direction of extending the pair of spacer portions (longitudinal direction). Therefore, where the pair of spacer portions are formed by bending both ends of the bottom housing portion in a square shape, the pair of spacer portions are difficult to bend in the short-length direction (vertical direction). Thus, when shock is applied to the spacer portions, these spacer portions are not bent but can be elastically deformed. Correspondingly, the shock absorbing function of the spacer portions can be improved. Further, since the spacer portions are difficult to bend in the short-length direction (vertical direction), when shock is applied to the pair of spacer portions in the short-length direction (vertical direction) owing to drop of the corrugated cardboard box, a space can be prevented from being formed between the upper surface of the styrofoam members 110 and the inner face of the corrugated cardboard box owing to bending in the short-length direction (vertical direction) of the pair of spacer portions arranged in the gap between the upper surface of the styrofoam members and inner face of the corrugated cardboard box. As a result, the styrofoam members can be prevented from moving vertically, thus preventing the product from falling owing to the vertical movement of the styrofoam members. Further, the attachment supporting portion is provided to have a longitudinal area substantially in parallel to the direction of extending the cores of the corrugated cardboard. The longitudinal area of the attachment supporting portion, which extends substantially in parallel to the direction of extending the cores of the corrugated cardboard sheet, is difficult to bend. Thus, in the case where an attachment is placed on the attachment supporting portion which a slender shape, the attachment supporting portion can be prevented from bending downward.

In the packing structure according to the first aspect of the present invention, a tip projecting portion is provided in such a manner that the tip of the side of each the spacer portions on the side of bottom housing portion project downward from the spacer portions and arranged to be in contact with the projection of each the styrofoam members, respectively in such a manner that the styrofoam member is sandwiched by the tip projecting portion and each of the folding portions. Therefore, in the case where the corrugated cardboard box has dropped, the styrofoam members can be surely prevented from moving. Accordingly, the product can be surely prevented from falling owing to movement of the styrofoam members.

According to a second aspect of the invention, there is provided a corrugated-cardboard packing member arranged to be adjacent to a pair of holding members for holding a first article to be arranged within a corrugated cardboard box, the corrugated-cardboard packing member including: a bottom housing portion for housing a second article; a pair of spacer portions that are provided to project upward from the ends of said bottom housing portion and arranged in a gap between the upper surface of the pair of holding members and the inner surface of the corrugated cardboard box, an opening formed by cutting off a predetermined area of the bottom housing portion and folding back the remaining area downward; a second article supporting portion adjacent to said opening; and a folding portion which is arranged between the opposite sides of the pair of holding members and folded back downward in order to form the opening.

In the corrugated-cardboard packing member according to the second aspect of the present invention, as described above, the opening is provided by cutting off a predetermined area of the bottom housing portion of the corrugated cardboard packing member arranged to be adjacent to the pair of the holding member within the corrugated cardboard box and folding back the remaining area downward. Therefore, the planar area of the bottom housing portion of the corrugated-cardboard packing member is reduced as compared with the case where the no opening is provided. Correspondingly, the flexibility of the bottom housing portion can be improved. Thus, the bottom housing portion can have a shock absorbing function of reducing shock, thereby providing a corrugated-cardboard packing member with excellent shock resistance.

In the corrugated-cardboard packing member according to the second aspect of the present invention, a folding portion is arranged between the opposite sides of the pair of holding members and folded back downward in order to form the opening. This prevents the end of one of the pair of holding members which hold the product from moving toward the opposite holding member. Therefore, such an inconvenience can be obviated that when the corrugated-cardboard box has dropped, the first article falls from the pair of holding members owing to the movement of the end of one of the pair of holding members to the opposite holding member.

In the corrugated-cardboard packing member according to the second aspect of the present invention, preferably, the pair of spacer portions are formed by bending both ends of the bottom housing portion in a square shape, and the cores of the corrugated cardboard sheet extend in a direction substantially orthogonal to the direction of extending the pair of spacer portions. In such a configuration, the pair of spacer portions become difficult to bend in the short-length direction (vertical direction). Thus, when shock is applied to the spacer portions, these spacer portions are not bent but can be elastically deformed. Correspondingly, the shock absorbing function of the spacer portions can be improved. Further, since the spacer portions are made difficult to bend in the short-length direction (vertical direction), a space can be prevented from being formed between the upper surface of the holding members and the inner face of the corrugated cardboard box owing to bending in the short-length direction (vertical direction) of the pair of spacer portions in the gap between the upper surface of the holding members and inner face of the corrugated cardboard box. As a result, the holding members can be prevented from moving vertically, thus preventing the first article from falling owing to the vertical movement of the holding members.

In the corrugated-cardboard packing member according to the second aspect of the present invention, preferably, the second article holding portion has a longitudinal area substantially in parallel to the direction of extending the cores of the corrugated cardboard. According to such a configuration, the longitudinal portion, which extends substantially in parallel to the direction of extending the cores of the corrugated cardboard sheet, is difficult to bend. Thus, in the case where the second article is placed on the attachment supporting portion which a slender shape, the second article supporting portion can be prevented from bending downward.

In the corrugated-cardboard packing member according to the second aspect of the present invention, it is preferred that the holding member includes a projection on the upper surface; the pair of spacer portions are formed by bending both ends of the bottom housing portion in a square shape; and a tip projecting portion which is formed in such a manner that the tip of the side of each the spacer portions on the side of bottom housing portion project downward from the spacer portions and arranged to be in contact with the projection of each the holding members, respectively in such a manner that the holding member is sandwiched by the tip projecting portion and each of the folding portions. According to such a configuration, when the corrugated cardboard box has dropped, the holding members can be prevented from being moved. This prevents the first article from falling owing to the movement of the holding members.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A packing structure comprising:

a corrugated-cardboard box for housing a product;

a pair of styrofoam members each of which is arranged within the corrugated cardboard box and includes a concave portion for supporting the side of the product; and a corrugated-cardboard packing member arranged to be adjacent to the pair of styrofoam members within the corrugated-cardboard box and includes a bottom housing portion for housing an attachment and a pair of spacer portions which are formed by bending both ends of the bottom housing portion in a square shape and arranged in a gap between the upper surface of the styrofoam members and the inner surface of the corrugated cardboard box, wherein the pair of styrofoam members each includes a projection on the upper surface, wherein the corrugated-cardboard packing member is formed so that cores of a corrugated cardboard sheet extend in a direction orthogonal to the direction of extending the pair of spacer portions, wherein the corrugated-cardboard packing member includes:

a pair of openings formed by cutting off two predetermined areas of the bottom housing portion in a three edges of a square, respectively and folding back the remaining area downward;

an attachment supporting portion located between the pair of openings and having a longitudinal area extending in a direction substantially in parallel to the direction of extending the cores of the corrugated cardboard;

a pair of folding portions arranged between the opposite sides of the pair of styrofoam members and folded back downward in order to form said pair of openings; and a tip projecting portion formed in such a manner that the tip of the side of each said spacer portions on the side of bottom housing portion project downward from the spacer portions and arranged to be in contact with said projection of each said styrofoam members, respectively in such a manner that the styrofoam member is sandwiched by the tip projecting portion and each of the folding portions.

2. A corrugated-cardboard packing member adapted to be adjacent to a pair of holding members for holding a first article arranged within a corrugated cardboard box, the corrugated-cardboard packing member comprising:

a bottom housing portion for housing a second article;

a pair of spacer portions, each spacer portion folded upward from a respective end of said bottom housing portion and arranged in a gap between the upper surface of the pair of holding members and the inner surface of the corrugated cardboard box, an opening formed by cutting a predetermined area from the bottom housing portion and folding the predetermined area downward, forming a folding portion;

a second article supporting portion adjacent to said opening configured to support a second article;

wherein the folding portion is arranged between the pair of holding members, wherein each holding member includes a projection on the upper surface, wherein the pair of spacer portions are formed by bending both ends of the bottom housing portion in a square shape, and wherein tip projecting portions are formed such that a tip of a side of each spacer portion on a side of bottom housing portion projects downward from each spacer portion and is configured to contact said projection of said holding member, respectively, in such a manner that the holding member is sandwiched by the tip projecting portion and each of the folding portions.

3. The corrugated-cardboard packing member according to claim 2, wherein the pair of spacer portions are formed by bending ends of the bottom housing portion in a square shape, and wherein cores of corrugated cardboard of the corrugated-cardboard packing member extend in a direction orthogonal to a direction of extension of said pair of spacer portions.

4. The corrugated-cardboard packing member according to claim 2, wherein the second article supporting portion has a longitudinal area extending substantially in parallel to a direction of extension of the cores of said corrugated cardboard.

5. The corrugated-cardboard packing member according to claim 2, further comprising:

a second opening formed by cutting a second predetermined area from the bottom housing portion and folding the second predetermined area downward, forming a second folding portion;

wherein the second folding portion is arranged between the pair of holding members.

* * * * *